US006241650B1

(12) United States Patent
Letourneur

(10) Patent No.: US 6,241,650 B1
(45) Date of Patent: Jun. 5, 2001

(54) CENTIFUGE WITH PNEUMATIC DRIVE AND FILTRATION OF THE ATMOSPHERE OF ITS CHAMBER

(75) Inventor: Jeau Claude Letourneur, Pornichet (FR)

(73) Assignee: Jouan, Saint-Herblain (FR)

( * ) Notice: Subject to any disclaimer, the term of this patent is extended or adjusted under 35 U.S.C. 154(b) by 0 days.

(21) Appl. No.: 09/505,296

(22) Filed: Feb. 16, 2000

(30) Foreign Application Priority Data

Mar. 1, 1999 (FR) ..... 99 02 511

(51) Int. Cl.[7] ..... B04B 5/02; B04B 9/06; B04B 15/02; B04B 15/08

(52) U.S. Cl. ..... 494/11; 494/12; 494/14; 494/16; 494/24; 494/25; 494/36; 494/84

(58) Field of Search ..... 494/11, 12, 13, 494/14, 16, 20, 23–26, 31, 33, 35, 36, 60, 61, 84; 422/72

(56) References Cited

U.S. PATENT DOCUMENTS 731,215 * 6/1903 Patterson .
773,220 * 10/1904 Patterson .
1,989,213 * 1/1935 Schenck .
2,733,857 * 2/1956 Beams .
2,875,949 * 3/1959 Tarsoly .
2,899,131 * 8/1959 Wohler .
3,108,955 * 10/1963 Boyland .
3,958,753 * 5/1976 Durland et al. .
4,036,428 7/1977 Durland .
4,941,866 * 7/1990 Gorodissky et al. ..... 494/14
5,280,975 * 1/1994 Tscheu et al. ..... 494/12

FOREIGN PATENT DOCUMENTS 648 769 4/1985 (CH) .
10 34 550 7/1958 (DE) .

* cited by examiner

*Primary Examiner*—Charles E. Cooley
(74) *Attorney, Agent, or Firm*—Larson & Taylor PLC

(57) ABSTRACT

This centrifuge includes a chamber (5), a rotor (6) arranged therein, and a device (8) for driving the rotation of the rotor. The device (8) for driving the rotation of the rotor is a pneumatic drive device. The centrifuge includes a circuit for supplying the pneumatic drive device with pressurized gas intended to be connected to a source (49) of pressurized gas. The centrifuge further includes a gas-purification unit (10), one inlet of this unit being connected to an outlet (64) for drawing gas from the chamber and one outlet of this unit being connected to a suction device (21) controlled by the pressurized gas supplied to the pneumatic device (8) for driving the rotor. Application is to the centrifuging of products liable to release dangerous substances, for example toxic or explosive substances.

21 Claims, 5 Drawing Sheets

CENTIFUGE WITH PNEUMATIC DRIVE AND FILTRATION OF THE ATMOSPHERE OF ITS CHAMBER

FIELD OF THE INVENTION

The present invention relates to a centrifuge comprising a chamber, a rotor arranged therein, and means for driving the rotation of the rotor.

The invention applies in particular to the centrifuging of products liable to release dangerous substances, for example toxic or explosive substances.

BACKGROUND OF THE INVENTION

Hitherto, such products have been placed in leak-tight containers which are arranged in housings, themselves leak-tight, in the rotor. The leak-tightness of the containers and of the housings is ensured, in particular, using seals.

It is thus possible to limit the risks of emission of dangerous substances from the chamber of the centrifuge.

However, these precautions do not make it possible to eliminate the risks of such emissions if, for example, the housings and/or the containers are not closed correctly or if their seals are worn.

BRIEF SUMMARY OF THE INVENTION

The object of the invention is to solve this problem by providing a centrifuge capable of centrifuging, under improved conditions of safety, products liable to release dangerous substances.

To this end, the subject of the invention is a centrifuge comprising a chamber, a rotor arranged therein, and means for driving the rotation of the rotor, characterized in that the means for driving the rotation of the rotor are pneumatic drive means, the centrifuge comprising a circuit for supplying the said pneumatic drive means with pressurized gas, which supply circuit is intended to be connected to a source of pressurized gas, and in that the centrifuge comprises a gas-purification unit, one inlet of this unit being connected to an outlet for drawing gas from the chamber, and one outlet of this unit being connected to a suction device controlled by the pressurized gas supplied to the pneumatic means for driving the rotation of the rotor.

According to particular embodiments of the invention, the centrifuge may comprise one or more of the following features, taken in isolation or in any technically feasible combination:

- the pneumatic means for driving the rotation of the rotor comprise a turbine,
- the said outlet of the purification unit is connected to the circuit for supplying pressurized gas to the pneumatic means for driving the rotation of the rotor,
- the suction device comprises a venturi injection system including an injector of entraining fluid intended to be connected to the said source of pressurized gas, an inlet for entrained fluid connected to the said outlet of the purification unit, and an outlet for entraining fluid and entrained fluid which is connected to the pneumatic means for driving the rotor,
- the centrifuge comprises means for cooling the atmosphere of the chamber,
- the means for cooling the atmosphere of the chamber comprise means for introducing a cooling gas into the chamber,
- the means for introducing a cooling gas into the chamber comprise an outlet for cooling gas arranged under the rotor to direct the cooling gas towards the latter,

- the means for introducing a cooling gas comprise a Ranque vortex tube, a cold outlet of which is connected to one inlet of the chamber,
- one inlet of the said Ranque vortex tube is connected to the said pressurized-gas supply circuit,
- the centrifuge comprises a source of decontamination gas connected to one inlet of the chamber,
- the purification unit comprises at least one filter,
- the purification unit comprises at least one device for the chemical treatment of gas,
- the chamber is leak-tight,
- the centrifuge comprises a pneumatic device for braking the rotor connected to the said pressurized-gas supply circuit,
- the pressurized-gas supply circuit comprises a timer-controlled valve,
- the centrifuge comprises a door which can move between an open position for access to the inside of the chamber and a closed position, the centrifuge further comprises a pneumatic device for locking the door in its closed position, and the locking device is connected to the pressurized-gas supply circuit,
- the locking device comprises a first lock which can move between a position for locking and a position for unlocking the door, the first lock being secured to the rod of a first pneumatic ram connected via at least one individual pipe to the said pressurized-gas supply circuit, and the locking device comprises a valve for selectively switching the individual pipe or pipes to the pressurized-gas supply circuit,
- the supply circuit comprises an automatic-locking valve which itself includes a shut-off member which can move between a position for opening and a position for closing the automatic-locking valve, one outlet of this locking valve is connected to the said switching valve, and the said shut-off member of the automatic-locking valve is in the open position when the door of the centrifuge is in the closed position, and in the closed position when the door is in the open position, and the said switching valve, when at rest, places the said outlet of the automatic-locking valve and the first ram in communication so that the first lock is driven towards its locking position,
- the automatic-locking valve is intended to be permanently connected to the said source of pressurized gas,
- the said timer-controlled valve is connected to one outlet of the said automatic-locking valve,
- the locking device comprises a second lock which can move between a position of immobilizing the first lock in its locking position and a position of releasing the first lock, and the second lock is secured to the rod of a second pneumatic ram permanently connected to one outlet of the said timer-controlled valve.

BRIEF DESCRIPTION OF THE DRAWINGS

The invention will be better understood from reading the description which will follow which is given merely by way of example and made with reference to the appended drawings, in which.

DETAILED DESCRIPTION OF THE INVENTION

Figure 1:
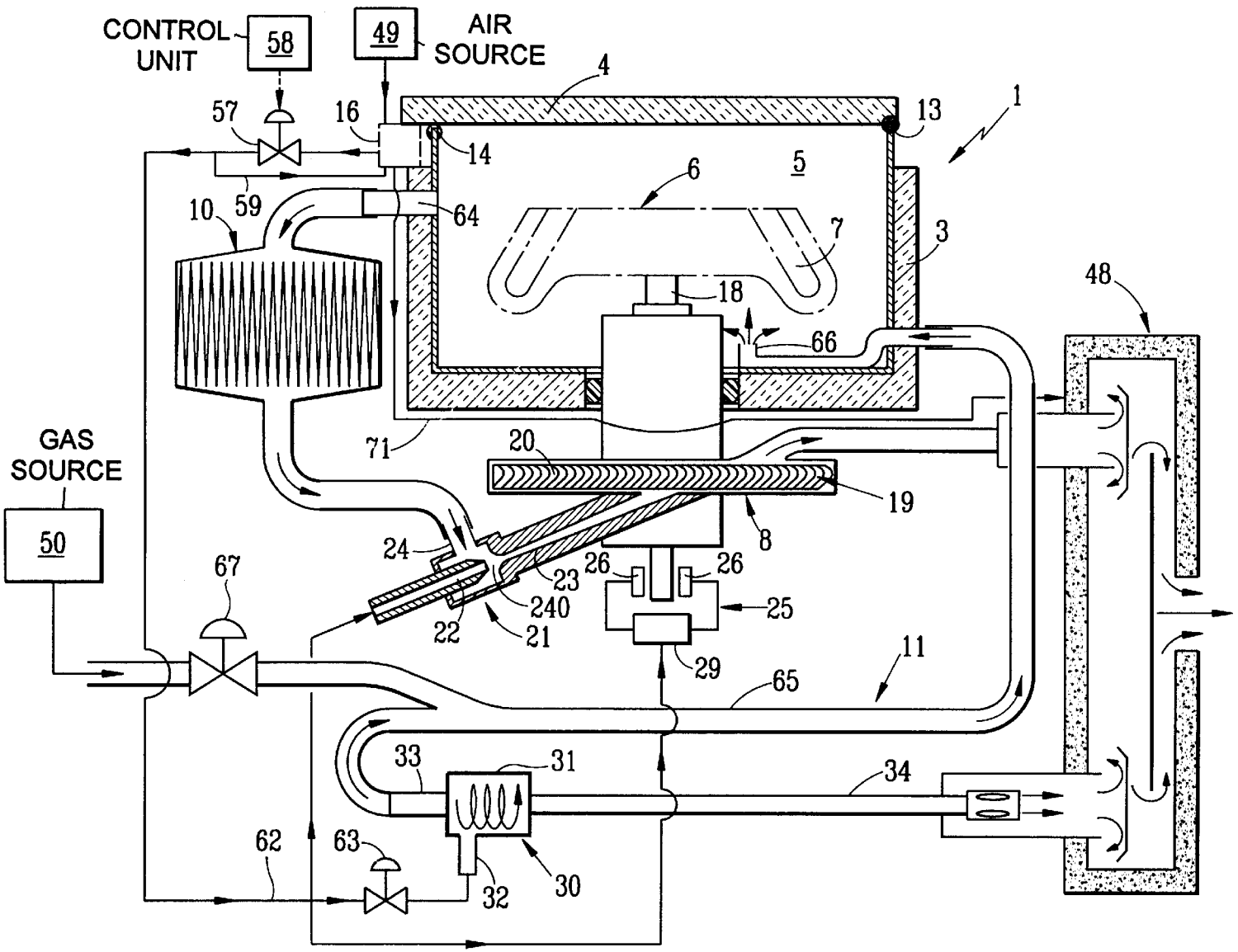
FIG. 1 is a diagrammatic side view, partially in section, of a centrifuge according to a preferred embodiment of the invention.

FIG. 1 diagrammatically depicts a centrifuge 1 which essentially comprises:

- a lagged tank 3 borne by a stand (not depicted) and fitted with a door 4, the tank 3 and the door 4 forming a chamber 5,
- a rotor 6 arranged in the chamber 5 and equipped with housings 7 for holding containers for products to be centrifuged,
- pneumatic means 8 for driving the rotation of the rotor 6,
- a unit 10 for purifying gas drawn from the chamber 5, and
- means 11 for cooling the atmosphere of the chamber 5.

The door 4 is hinged at 13 to the tank 3 so that it can move between a closed position, as depicted in FIG. 1, and an open position, not depicted, for access to the inside of the chamber 5.

When the door 4 is in the closed position, the chamber 5 is rendered leak-tight with respect to the outside, particularly by virtue of a seal 14 which is compressed between the door 4 and the tank 3.

In the open position, the door 4 is raised with respect to its closed position.

The centrifuge 1 further comprises a pneumatic device 16 (in dotted line) for locking the door 4 in the closed position. This device will be described later on with reference to FIG. 3.

The drive means 8 comprise a shaft 18 secured to the rotor 6 and a turbine 19, the blades 20 of which are depicted diagrammatically in FIG. 1. This turbine 19 is secured to the shaft 18.

The drive means 8 also comprise a venturi injection system 21 which itself includes:

- an injector 22 of entraining fluid,
- a divergent nozzle 23, the inlet of which is spaced slightly away from the outlet of the injector 22 and which opens near to the blades 20, and
- an inlet 24 for entrained fluid, communicating with the space 240 separating the inlet of the nozzle 23 from the outlet of the injector 22.

The centrifuge 1 also comprises a pneumatic brake 25 which comprises (FIG. 2) two jaws 26 articulated to a shaft 27 and arranged one on each side of the shaft 18 that drives the rotor 6.

Figure 2:
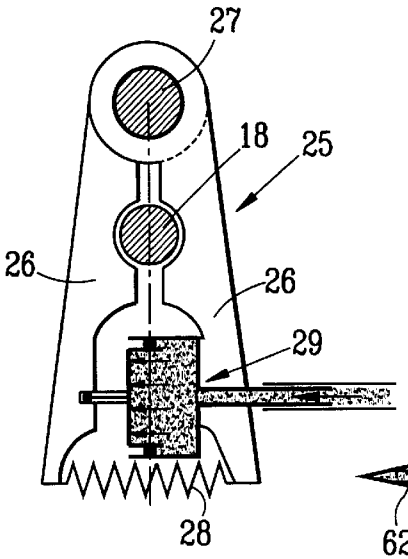
FIG. 2 is an enlarged diagrammatic view from above of the pneumatic brake of the centrifuge of FIG. 1.

These jaws 26 can move transversely to the shaft 18 between a close-together braking position (not depicted), in which they clamp the shaft 18, and a spaced-apart position, in which the shaft 18 turns freely between the jaws 26 as depicted in FIG. 2.

The brake 25 further comprises a spring 28 for returning the jaws 26 to their close-together position and a single-acting pneumatic ram 29 arranged between the jaws 23. When the pneumatic ram 29 is supplied with pressurized gas, as depicted diagrammatically in grey in FIG. 2, the jaws 26 are in the spaced-apart position. When the ram 29 is not supplied with pressurized gas, the jaws 26 are in the close-together position.

The gas-purification unit 10 comprises, for example, a filter of the HEPA type.

The means 11 for cooling the atmosphere of the chamber 5 comprise a Ranque vortex tube 30. This conventional device comprises a vortex-flow generator 31 to which are connected one inlet 32 for supplying pressurized gas, a cold outlet 33 and a hot outlet 34 for gas.

Figure 3:
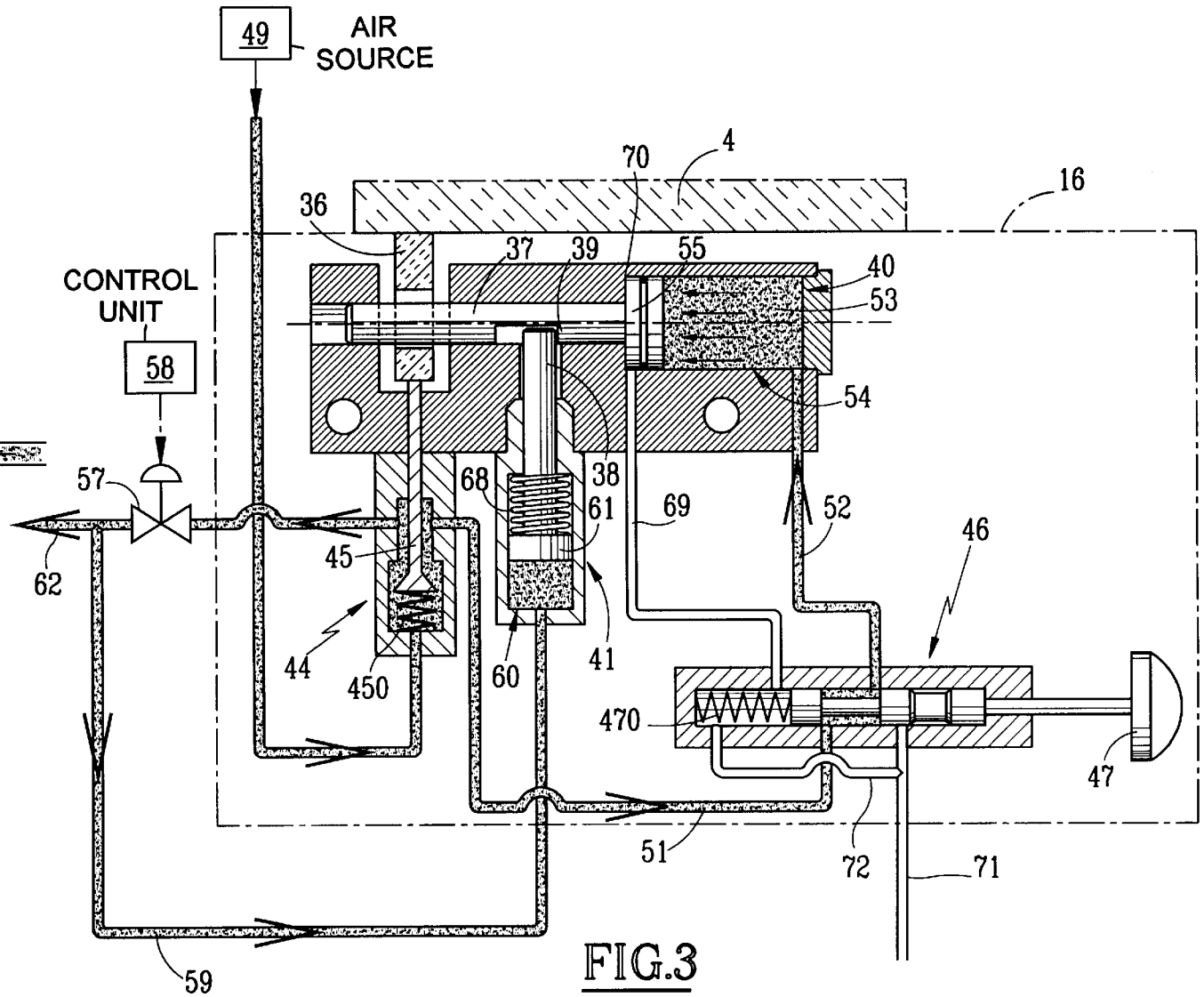
FIGS. 3 to 5 are enlarged diagrammatic views, in section, illustrating the structure and operation of the device for locking the door of the centrifuge of FIG. 1.

As illustrated in FIG. 3, the locking device 16 comprises a keeper 36 secured to the door 4, a first lock 37 and a second lock 38.

The first lock 37 can slide between a position for locking the door 4 (FIG. 3), in which the first lock is engaged in the keeper 36, and a position for unlocking the door (FIG. 5), in which the lock 37 is withdrawn from the keeper 36.

Figure 5:
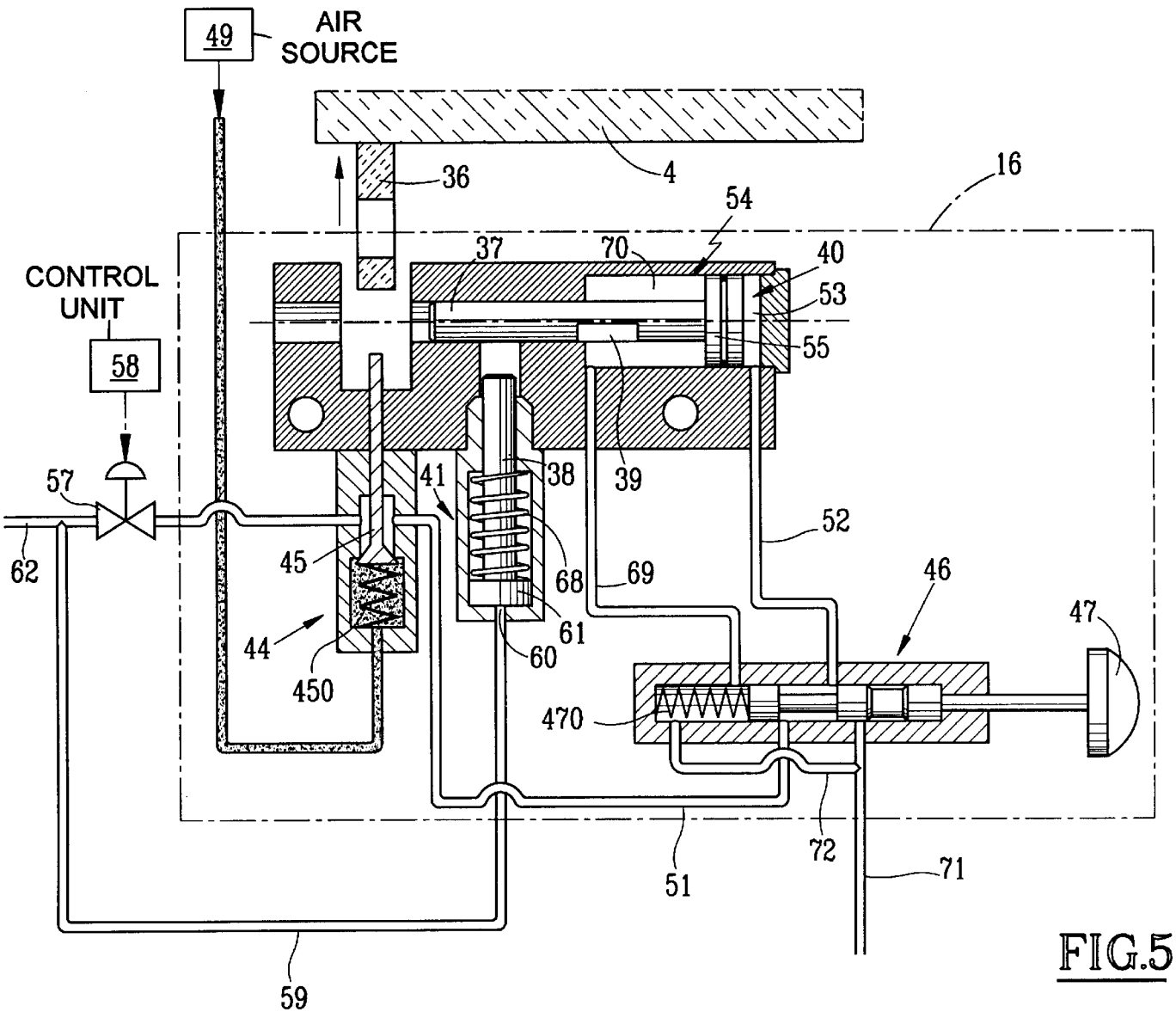

The second lock 38 can slide at right angles to the first lock between a position of immobilizing the first lock 37 in its locking position (FIG. 3), and a position of releasing the first lock 37 (FIG. 5).

In its immobilizing position, the second lock 38 is engaged in a recess 39 made in the first lock 37.

The first lock consists of the rod of a first double-acting pneumatic ram 40, and the second lock 38 consists of the rod of a second single-acting pneumatic ram 41.

The pneumatic locking device 16 also comprises:

- a three-way two-position automatic-locking valve 44, the shut-off member 45 of which is held in the open position, against the effect of a spring 450, by the keeper 36 of the door 4 when the latter is in the closed position, and
- a five-way, two-position switching valve 46, the shut-off member 47 of which can be operated manually.

The shut-off member 47 can slide between a position for unlocking the door 4, in which it compresses a spring 470, and a position for locking the door 4, or position of rest, in which the spring 470 is not compressed.

The centrifuge further comprises a silencer 48, a source 49 of pressurized air and a source 50 of decontamination gas, for example formal. The air of the source 49 is, for example, at a pressure of between 3 and 6 bar.

The structure of the fluid circuit connecting the various elements of the centrifuge 1 will become clearly apparent during the description of the operation of this centrifuge 1, which will be given, to start with, on the basis of FIGS. 1 and 3.

Figure 4:
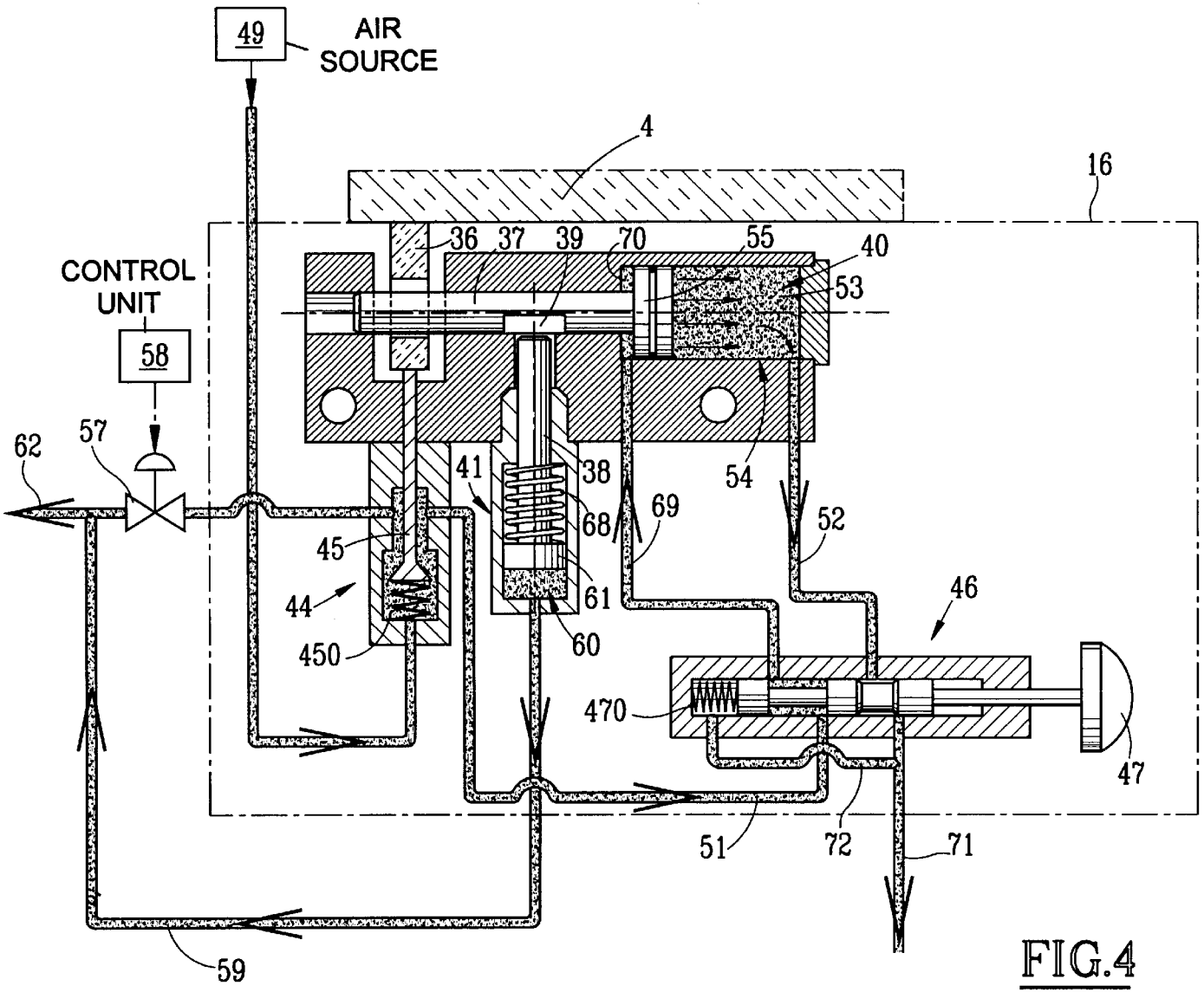

In FIG. 3, as in FIGS. 4 and 5, the inside of the pipes containing pressurized air is depicted in grey.

With the door 4 in the closed position, pressurized air from the source 49 passes through the automatic-locking valve 44, which is in the open position, and is then split into two streams.

The first of these streams is conveyed by a pipe 51 to the switching valve 46. As the shut-off member 47 is at rest, that is to say in the position for locking the door 4, this first stream is then conveyed by an individual pipe 52 to a first part 53 of the chamber 54 of the first ram 40.

This first stream pushes back the piston 55 of the first ram 40 to the left in FIG. 3, so that the first lock 37 is pushed into its position for locking the door 4.

It will be noted that when the shut-off member 47 is at rest, the first part 53 of the chamber 54 of the first ram 40 is automatically placed in communication with an outlet of the valve 44 and therefore with the source 49, so that locking of the door 4 is automatic.

The second stream from the automatic-locking valve 44 passes through a valve 57 which is timer-controlled by a control unit 58 which keeps it open during centrifuging. The control unit 58 is, for example, a pneumatic or mechanical unit.

This second stream is itself split into two streams as it leaves the valve 57.

The first of these streams is sent, via a pipe 59, to the chamber 60 of the second ram 41 so as to push the piston 61 of this ram upwards in FIG. 3, so that the second lock 38 is pushed into its position for immobilizing the first lock 37.

Thus, throughout centrifuging, that is to say as long as the valve 57 is open, the second lock 38 is in a position of immobilizing the first lock 37, and it is therefore impossible to unlock the door 4.

The second stream of pressurized air from the valve 57 is conveyed by a pipe 62 and is then supplied to (FIG. 1):

the inlet 32 of the Ranque vortex tube 30, via a manual valve 63, the ram 29 of the pneumatic brake 25, constantly, and the injector 22 of the venturi injection system 21, constantly.

Thus, throughout centrifuging, the pneumatic ram 29 of the brake 25 is supplied with pressurized air so that the jaws 26 are in the spaced-apart position and allow the shaft 18 to turn freely.

The injection of pressurized air by the injector 22 creates a depression at the periphery of the space 240 and therefore at the inlet 24 of the venturi injection system. Gas is thus drawn via an outlet 64 of the chamber 5, then filtered in the filter 10. This drawn-off and filtered gas is then sucked into the venturi injection system 21 through the inlet 24, then ejected from the nozzle 23 with the pressurized air from the injector 22, driving the turbine 19, the shaft 18 and the rotor 6.

Having driven the turbine 19, this flow of fluid is then removed to outside the centrifuge 1 via the silencer 48.

The pressure-reduced air from the hot outlet 34 of the Ranque vortex tube is also removed to outside the centrifuge 1 via the silencer 48.

The low-temperature, for example −10° C., pressure-reduced air from the cold outlet 33 of the Ranque vortex tube is conveyed by a pipe 65 to an inlet 66 of the chamber 5. The cold air is ejected from this inlet 66 under and towards the rotor 6, therefore cooling the atmosphere of the chamber 5.

It is possible, by opening a manual valve 67, to cause the decontamination gas to flow from the source 50 into the pipe 65 then into the chamber 5 and thus sweep the atmosphere of the chamber 5, of the filter 10, of the turbine 19 and of the silencer 48 with this decontamination gas.

At the end of the centrifuging cycle, the valve 57 is automatically closed by the control unit 58. As the pneumatic ram 29 of the brake 25 is no longer supplied with pressurized air, the jaws 26 will automatically position themselves in the close-together position for braking the rotor 6.

As illustrated by FIG. 4, the pressurized air contained in the chamber 60 of the second ram 41 is removed by the pipe 59 then by the pipe 62 to the silencer 48, and the piston 61 of the second ram 41 is pushed back by a spring 68. Thus, the second lock 38 is returned to its position of releasing the first lock 37.

By manually bringing the shut-off member 47 of the switching valve 46 into its unlocking position, the pipe 51 is therefore placed in communication, via an individual pipe 69, with a second part 70 of the chamber 54 of the first double-acting ram 40. Thus, this second part 70 of the chamber 54 is supplied with pressurized air because the automatic-locking valve 44 is in the open position.

At the same time, the first part 53 of the chamber 54 is vented, via a pipe 71 (FIGS. 1 and 4) then via the silencer 48.

Thus, the piston 55 of the first ram is pushed back to the right in FIG. 1 and the first lock 37 is returned to its unlocking position.

When the first lock 37 is in the unlocking position, it is possible to open the door 4.

When the door 4 leaves its closed position (FIG. 5), the shut-off member 45 of the valve 44 is returned by the spring 450 to its position of closing the valve 44.

Now that the shut-off member 47 of the switching valve 46 has been returned to its position of rest by the spring 470, the pressurized air present in the second part 70 of the chamber 54 of the first ram 40 has been removed by, in succession, a pipe 72, the pipe 71 and the silencer 48.

The centrifuge 1 contains no electrical devices. This characteristic is particularly advantageous for the centrifuging of products liable to release explosive substances.

Moreover, the combination of the pneumatic means 8 for driving the rotor 6 and the unit 10 for purifying the gas drawn from the chamber 5, in which the circulation of drawn-off gas is brought about by the pressurized air driving the turbine 19, makes it possible simultaneously to drive the rotor 6 and to filter the atmosphere of the chamber 5. Thus, the centrifuge 1 is suited to the centrifuging of dangerous products by limiting the risks of these substances being emitted to outside the centrifuge 1.

It is to be noted that the use of the venturi injection system 21 delivering, at output, a flow rate of gas which is greater than that with which the injector 22 is supplied, allows the turbine 19 and therefore the rotor 6 to be driven at relatively high speeds.

Furthermore, the possibility of decontaminating the atmosphere of the chamber further limits the risks associated with the centrifuging of such products.

The use of an injection of cold gas, particularly one obtained using a Ranque vortex tube, allows satisfactory cooling of the atmosphere of the chamber 5, with good efficiency and limiting the emissions of heat to outside the chamber 5. What is more, the use of the Ranque vortex tube makes it possible to limit the size of the means 11 for cooling the atmosphere of the chamber 5.

It will also be noted that the use of a turbine 19 for driving the rotor 6 makes it possible to limit the emissions of heat to outside the chamber 5.

According to an alternative form which has not been depicted, the gas-purification unit 10 comprises a device for the chemical treatment of gases drawn from the chamber 5, which allows the dangerous substances likely to be released by the products being centrifuged to be neutralized.

Figure 6:
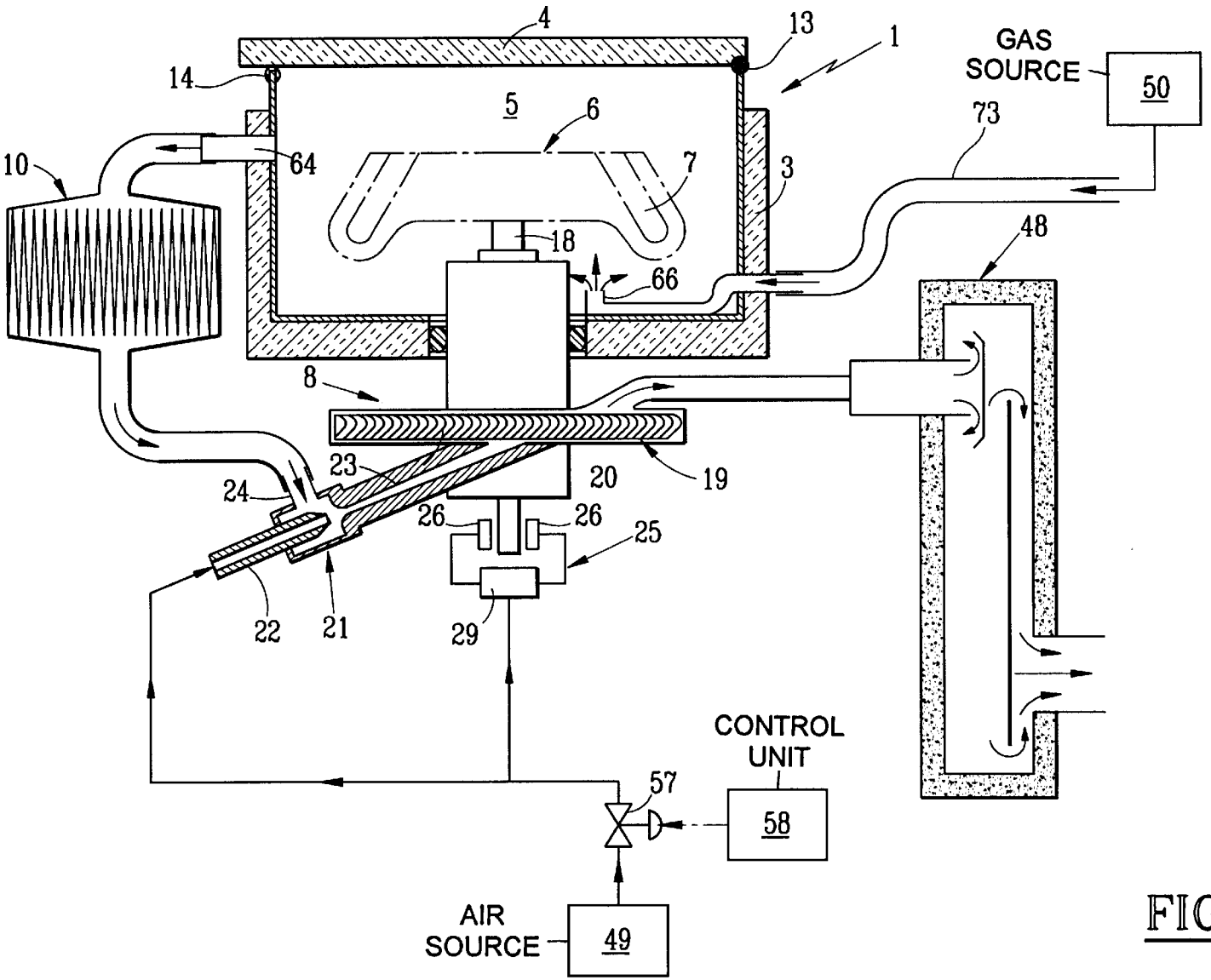
FIG. 6 is a view similar to FIG. 1 illustrating another embodiment.

FIG. 6 illustrates a simplified embodiment of a centrifuge 1.

In this embodiment, for which the pneumatic locking device 16 has not been depicted for reasons of greater clarity, the centrifuge comprises no Ranque vortex tube. The inlet 66 to the chamber 5 is then connected by a pipe 73 to the source 50 of decontamination gas which may also act as cooling gas.

According to an alternative form which has not been depicted, the pipe 73 is equipped with a switching valve allowing the inlet 66 of the chamber 5 to be connected selectively either to the external atmosphere or to the source 50 of decontamination gas.

I claim:

1. Centrifuge comprising:

a chamber, a rotor arranged therein, and means for driving the rotation of the rotor, wherein the means for driving the rotation of the rotor are pneumatic drive means, a circuit for supplying said pneumatic drive means with pressurized gas, which said supply circuit is intended to be connected to a source of pressurized gas, and a gas-purification unit, one inlet of this unit being connected to an outlet for drawing gas from the chamber, and one outlet of this unit being connected to a suction device controlled by the pressurized gas supplied to the pneumatic drive means for driving the rotation of the rotor.

2. Centrifuge according to claim 1, wherein the pneumatic drive means for driving the rotation of the rotor comprise a turbine.

3. Centrifuge according to claim 1, wherein said outlet of the purification unit is connected to the circuit for supplying pressurized gas to the pneumatic drive means for driving the rotation of the rotor.

4. Centrifuge according to claim 3, wherein the suction device comprises a venturi injection system including an injector of entraining fluid intended to be connected to said source of pressurized gas, an inlet for entrained fluid connected to said outlet of the purification unit, and an outlet for entraining fluid and entrained fluid which is connected to the pneumatic drive means for driving the rotor.

5. Centrifuge according to claim 1, further comprising means for cooling the atmosphere of the chamber.

6. Centrifuge according to claim 5, wherein the means for cooling the atmosphere of the chamber comprise means for introducing a cooling gas into the chamber.

7. Centrifuge according to claim 6, wherein the means for introducing a cooling gas into the chamber comprise an outlet for cooling gas arranged under the rotor to direct the cooling gas towards the rotor.

8. Centrifuge according to claim 6, wherein the means for introducing a cooling gas comprise a Ranque vortex tube, a cold outlet of which is connected to one inlet of the chamber.

9. Centrifuge according to claim 8, wherein one inlet of said Ranque vortex tube is connected to said pressurized-gas supply circuit.

10. Centrifuge according to claim 1, further comprising a source of decontamination gas connected to one inlet of the chamber.

11. Centrifuge according to claim 1, wherein the purification unit comprises at least one filter.

12. Centrifuge according to claim 1, wherein the purification unit comprises at least one device for the chemical treatment of gas.

13. Centrifuge according to claim 1, wherein the chamber is leak-tight.

14. Centrifuge according to claim 1, further comprising a pneumatic device for braking the rotor connected to said pressurized-gas supply circuit.

15. Centrifuge according to claim 1, wherein the pressurized-gas supply circuit comprises a timer-controlled valve.

16. Centrifuge according to claim 1, further comprising a door which can move between an open position for access to the inside of the chamber and a closed position, and a pneumatic device for locking the door in the closed position, and wherein the pneumatic locking device is connected to the pressurized-gas supply circuit.

17. Centrifuge according to claim 16, wherein the pneumatic locking device comprises a first lock which can move between a position for locking and a position for unlocking the door, the first lock being secured to a rod of a first pneumatic ram connected via at least one individual pipe to said pressurized-gas supply circuit, and wherein the pneumatic locking device comprises a valve for selectively switching the at least one individual pipe to the pressurized-gas supply circuit.

18. Centrifuge according to claim 17, wherein the supply circuit comprises an automatic-locking valve which includes a shut-off member which can move between a position for opening and a position for closing the automatic-locking valve, one outlet of this locking valve being connected to said switching valve, wherein said shut-off member of the automatic-locking valve is in the open position when the door of the centrifuge is in the closed position, and in the closed position when the door is in the open position, and wherein said switching valve, when at rest, places said outlet of the automatic-locking valve and the first ram in communication so that the first lock is driven towards the locking position thereof.

19. Centrifuge according to claim 18, wherein the automatic-locking valve is intended to be permanently connected to said source of pressurized gas.

20. Centrifuge according to claim 18, wherein the pressurized-gas supply circuit comprises a timer-controlled valve which is connected to one outlet of said automatic-locking valve.

21. Centrifuge according to claim 17, wherein the pressurized-gas supply circuit comprises a timer-controlled valve, wherein the locking device comprises a second lock which can move between a position of immobilizing the first lock in the locking position thereof and a position of releasing the first lock, and wherein the second lock is secured to the rod of a second pneumatic ram permanently connected to one outlet of said timer-controlled valve.

* * * * *